US011142952B1

(12) United States Patent
Harvey et al.

(10) Patent No.: US 11,142,952 B1
(45) Date of Patent: Oct. 12, 2021

(54) SYSTEM, METHOD AND APPARATUS FOR WELL STRING CLUTCH

(71) Applicant: GENERAL DOWNHOLE TOOLS, LTD., Calgary (CA)

(72) Inventors: Mike Harvey, Calgary (CA); Dave Devlin, Calgary (CA); Jovan Vracar, Calgary (CA)

(73) Assignee: General Downhole Tools, Ltd., Calgary (CA)

( * ) Notice: Subject to any disclaimer, the term of this patent is extended or adjusted under 35 U.S.C. 154(b) by 130 days.

(21) Appl. No.: 16/576,241

(22) Filed: Sep. 19, 2019

Related U.S. Application Data

(60) Provisional application No. 62/734,652, filed on Sep. 21, 2018.

(51) Int. Cl.
*E21B 3/03* (2006.01)
*E21B 23/00* (2006.01)
*E21B 3/035* (2006.01)

(52) U.S. Cl.
CPC ..... *E21B 3/03* (2013.01); *E21B 3/035* (2013.01); *E21B 23/006* (2013.01)

(58) Field of Classification Search
CPC ..... E21B 3/03; E21B 3/035
See application file for complete search history.

(56) References Cited

U.S. PATENT DOCUMENTS 5,117,927 A * 6/1992 Askew ..... E21B 7/067 175/61
2013/0313022 A1* 11/2013 Kirkhope ..... E21B 23/00 175/104
2016/0024848 A1* 1/2016 Desmette ..... E21B 7/067 175/74
2020/0141187 A1* 5/2020 Lorenson ..... E21B 4/02

* cited by examiner

*Primary Examiner* — Tara Schimpf
(74) *Attorney, Agent, or Firm* — Dickinson Wright, PLLC; Michael E. Noe, Jr.

(57) ABSTRACT

A system, method and apparatus for a clutch for a well string can include a tubular member, a mandrel, a top sub and a bottom sub. A sleeve can be located between the tubular member and the mandrel. The sleeve has an engaged position wherein an inner sleeve spline is coupled to the mandrel spline, and a disengaged position wherein the inner sleeve spline is uncoupled from the mandrel spline. The sleeve has an outer sleeve spline that is coupled to the tubular spline in the engaged position and the disengaged position. A spring in the tubular member can bias the sleeve from one position to another position. The sleeve can be configured to be moved between the positions to overcome the spring bias.

19 Claims, 9 Drawing Sheets

LOCKED DISENGAGED-WOB

UNLOCKED ENGAGED-WOB

UNLOCKED DISENGAGED-PULL OUT

SYSTEM, METHOD AND APPARATUS FOR WELL STRING CLUTCH

This application claims priority to and the benefit of U.S. Prov. Pat. App. No. 62/734,652, filed Sep. 21, 2018, which is incorporated herein by reference in its entirety.

BACKGROUND OF THE INVENTION

Field of the Disclosure

The present invention relates in general to well strings in a well and, in particular, to a system, method and apparatus for a clutch for a well string.

Description of the Related Art

A conventional means of performing work in an oil or gas well includes drilling while pumping drilling fluid through a pipe or drill string to a drill bit that is cutting a hole in an earthen formation. Occasionally, there is a need to stop drilling and perform other functions in the well, such as hole cleaning and friction-breaking. However, those activities require the drill bit to continue to rotate with the drill string, which can be disadvantageous under some circumstances. Thus, improvements in operating and controlling well strings for different applications continue to be of interest.

SUMMARY

Embodiments of a system, method and apparatus for a clutch for a well string are disclosed. For example, the clutch can include a tubular member having an axis, a tubular spline, and a tubular thread on each end. A mandrel can be located in the tubular member. The mandrel can have a mandrel thread on a distal end and a mandrel spline proximal to the mandrel thread. A top sub can be coupled to the tubular member. The top sub can include a top sub thread coupled to the tubular thread. A bottom sub can be coupled to the mandrel. The bottom sub can include a bottom sub thread coupled to the mandrel thread. In addition, a sleeve can be located between the tubular member and the mandrel. The sleeve can have an engaged position wherein an inner sleeve spline is coupled to the mandrel spline, and a disengaged position wherein the inner sleeve spline is uncoupled from the mandrel spline. The sleeve also can include an outer sleeve spline that is coupled to the tubular spline in the engaged position. The outer sleeve spline also can be coupled to the tubular spline in the disengaged position. The clutch can include a spring located in the tubular member for biasing the sleeve from one position to another position. The sleeve can be configured to be hydraulically or mechanically biased from one position to another position to overcome the spring bias.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description can be had by reference to the embodiments thereof that are illustrated in the appended drawings. However, the drawings illustrate only some embodiments and therefore are not to be considered limiting in scope as there can be other equally effective embodiments.

The use of the same reference symbols in different drawings indicates similar or identical items.

DETAILED DESCRIPTION

Figure 1:
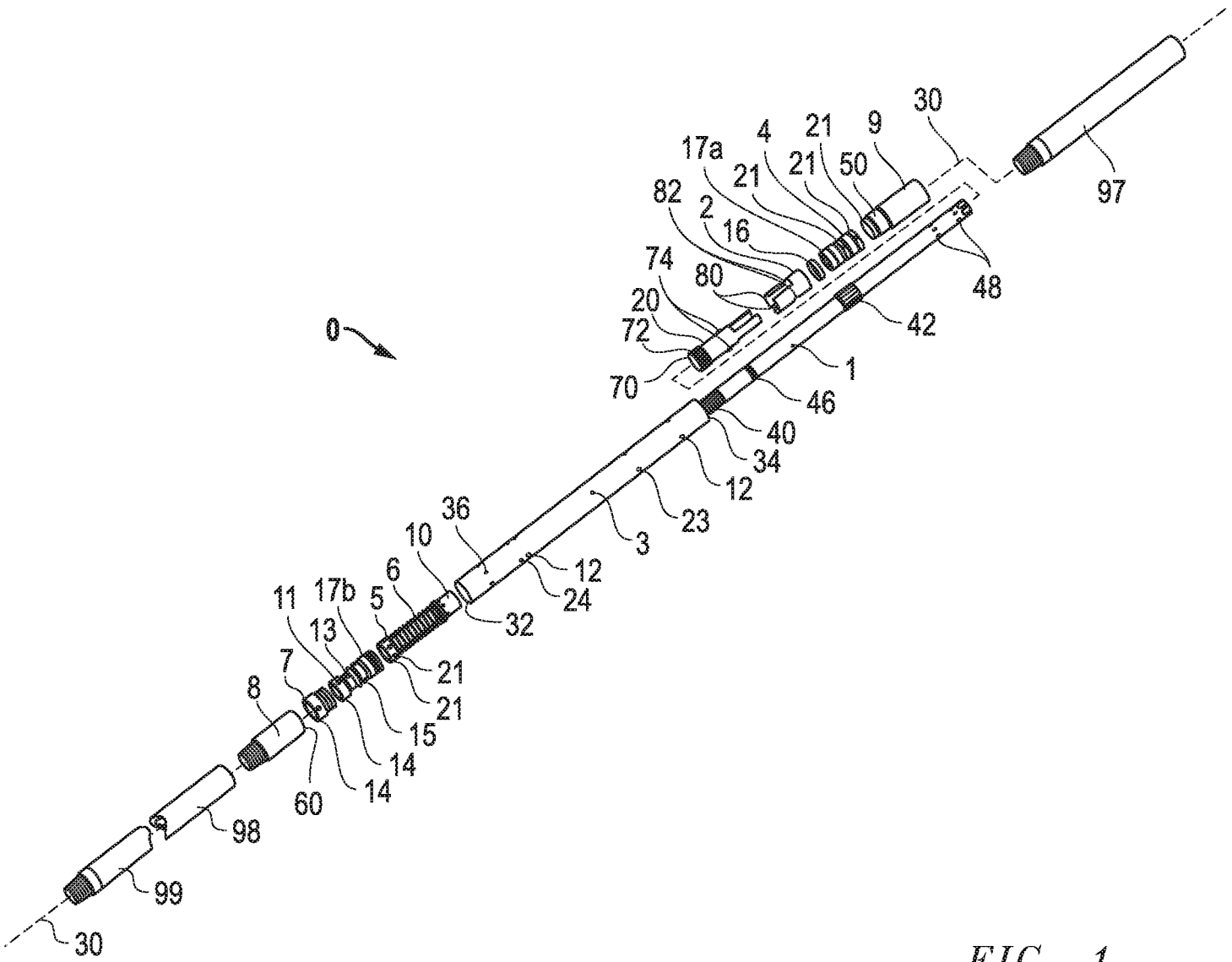
FIG. 1 is an exploded isometric view of an embodiment of a clutch for a well string and other well string components, shown unassembled.
Figure 2:
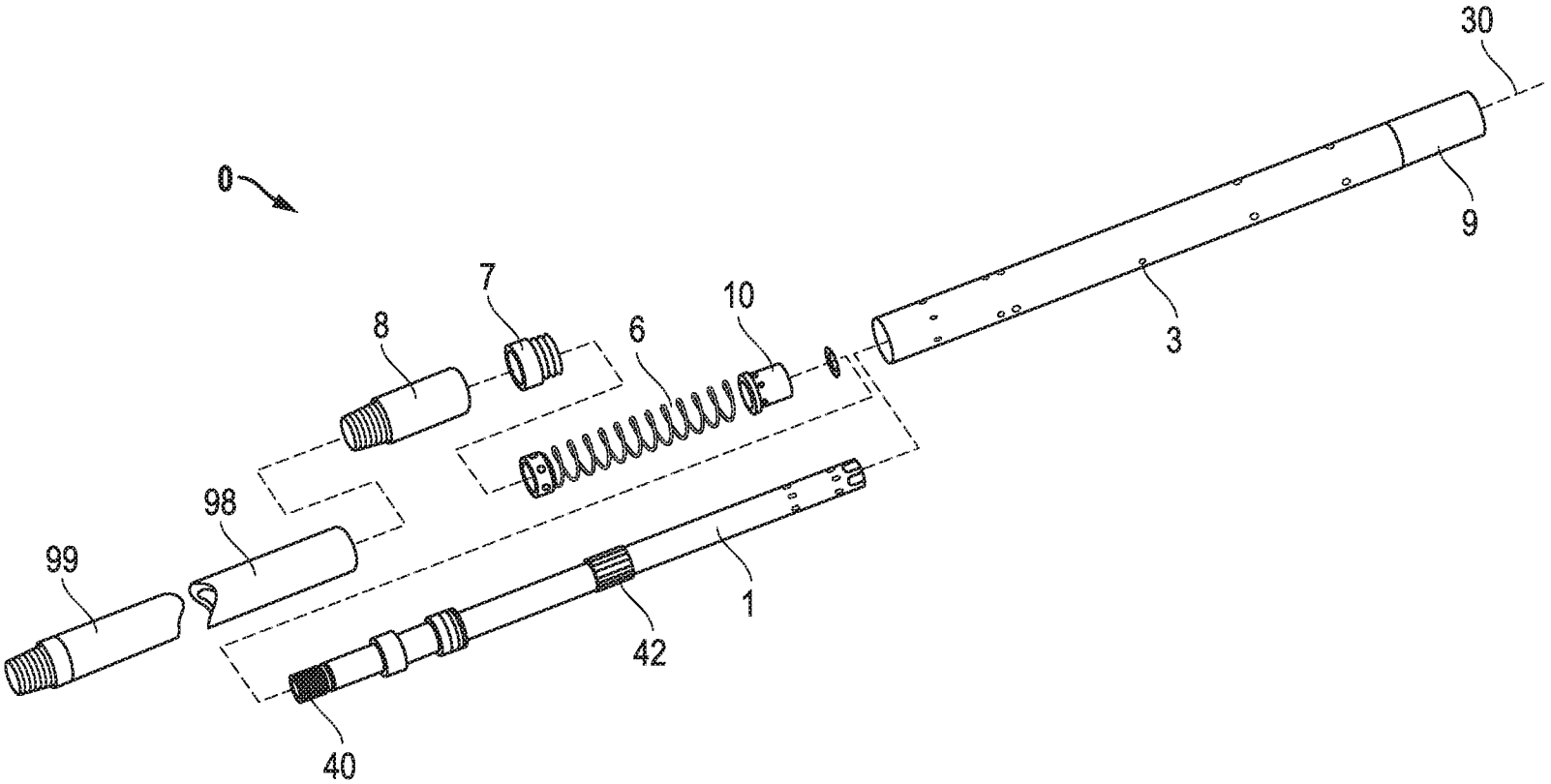
FIG. 2 is an exploded isometric view of an embodiment of a clutch and other well string components, shown partially assembled.
Figure 3C:
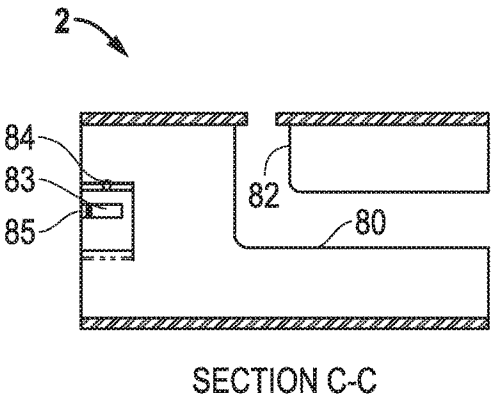
FIGS. 3A-3C are isometric, end and sectional side views, respectively, of an embodiment of a cam sleeve.
Figure 3B:
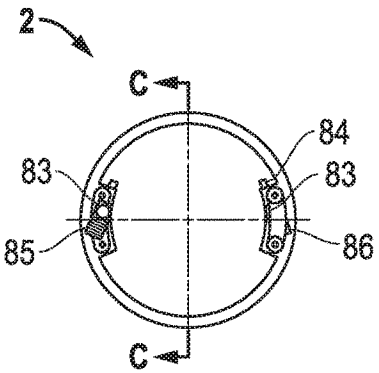
Figure 3A:
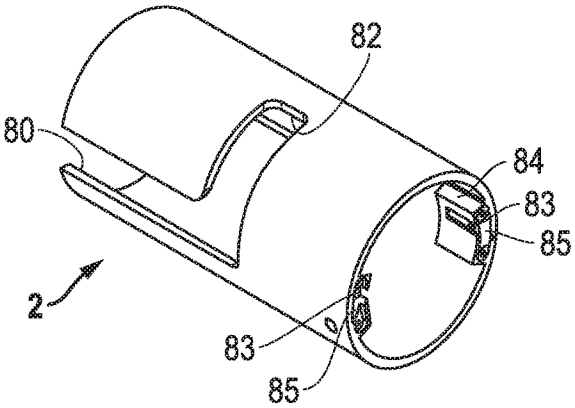

Embodiments of a system, method and apparatus for a clutch for a well string are disclosed. For example, FIGS. 1-6 depict a hydraulic version of a clutch 0 for a downhole component 99 in a well. Versions of the downhole component 99 depend on the type of string being used, but can include at least one of a bottom hole assembly (BHA; e.g., a drill bit, mud motor, collars and tools), a working string, a completion string, a production string and a fracturing string. The clutch 0 can be configured to be located axially uphole from the downhole component 99. In some versions, the clutch 0 is configured to be directly coupled or indirectly coupled to the downhole component 99 via at least one other component 98. In addition, the clutch 0 can be configured to be coupled to an uphole portion 97 of a string.

Embodiments of the clutch 0 can include a tubular member 3 having an axis 30, a tubular spline (in this example, on an interior thereof, not shown), and threads 32, 34 on ends thereof. Clutch 0 can further include a mandrel 1 located in the tubular member 3. In some versions, the mandrel 1 can have a mandrel thread 40 on a distal end and a mandrel spline 42 proximal to the mandrel thread 40.

Some embodiments of clutch 0 can include a top sub 9 coupled to the tubular member 3. Versions of the top sub 9 can have a top sub thread 50 coupled to the tubular thread 34. In addition, a bottom sub 8 can be coupled to the mandrel 1. Examples of the bottom sub 8 can have a bottom sub thread 60 (which can be internal) coupled to the mandrel thread 40.

Clutch 0 also can comprise a sleeve 20 located between the tubular member 3 and the mandrel 1. Embodiments of the sleeve 20 can have an engaged position (FIG. 4B) wherein an inner sleeve spline 70 (FIG. 1) is coupled to the mandrel spline 42.

Figure 4A:
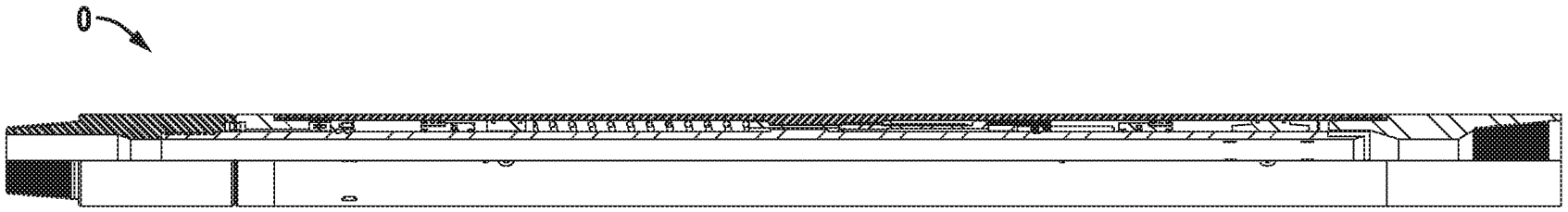
FIGS. 4A-4C are half-sectioned side views of an embodiment of a clutch showing unlocked disengaged, unlocked engaged, and locked disengaged positions, respectively.
Figure 4B:
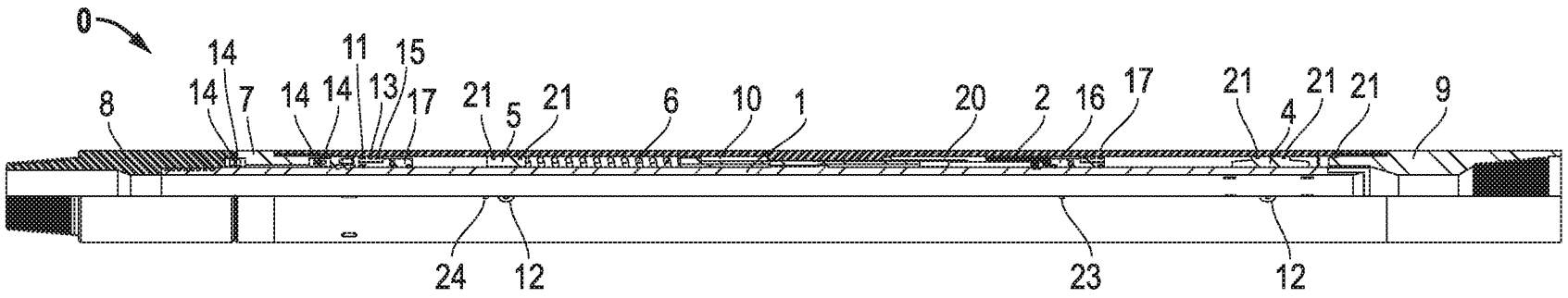
Figure 4C:
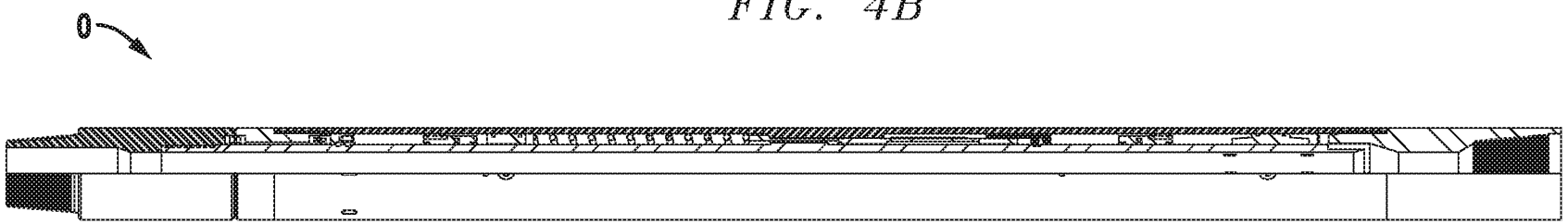

FIGS. 4A-4C depict half-sectioned side views of an embodiment of a clutch showing unlocked disengaged, unlocked engaged, and locked disengaged positions, respectively. Examples of sleeve 20 include the disengaged position (FIGS. 4A and 4C) wherein the inner sleeve spline 70 is uncoupled from the mandrel spline 42. Versions of the sleeve 20 can include an outer sleeve spline 72 that is coupled to the tubular spline (again, not shown) in the engaged position (FIG. 4B). Embodiments of the outer sleeve spline 72 also can be coupled to the tubular spline in the disengaged position.

Examples of clutch 0 can further include a spring 6 located in the tubular member 3 for biasing the sleeve 20 from the engaged position to the disengaged position. In one version, the spring 6 can be located downhole relative to the sleeve 20. Moreover, the sleeve 20 can be configured to be hydraulically biased from the disengaged position to the engaged position to overcome the spring bias when fluid flows through the clutch 0.

Embodiments of the clutch 0 also can include the spring 6 with a spring bushing 10, which can be coupled to the sleeve 20. In some examples, a spring retainer 5 and an o-ring 21 (e.g., two shown) can be located opposite the spring bushing 10. The spring retainer 5 can be secured to the tubular member 3 with screws 12. The spring 6 can be employed to push the spring bushing 10, which pushes sleeve 20.

Other embodiments of the clutch 0 can further comprise at least one of an end cap 7, an axial bearing 14 (e.g., two shown), a retainer ring 13 and a retainer plate 15. Examples of the axial bearing 14 can contain a polycrystalline diamond compact (PDC) bearing insert, and/or it can be coated with tungsten carbide. In addition, a spring piston assembly 17*b* (FIG. 1) can be coupled between the bottom sub 8 and the spring 6.

Embodiments of the mandrel 1 can include a set of grooves 46 adjacent its distal end. Grooves 46 can provide an anchor point for an axial bearing support 11, the retainer ring 13 and the retainer plate 15. In some examples, holes 48 can be provided on the proximal end of mandrel 1. Holes 48 can provide fluid flow to a space between the mandrel 1 and the tubular member 3 to act on an upper piston assembly 17*a*.

In some versions, the tubular member 3 can be provided with holes 36 adjacent its distal end. Holes 36 can provide fluid flow from the well to the space between the mandrel 1 and the tubular member 3. In some versions, the tubular member 3 does not have any inner grooves. Additionally, fasteners such as screws 12 can be used adjacent a proximal end of tubular member 3 to retain a position of a radial bearing 4. The distal end of tubular member 3 can include screws 12 to secure a position of a spring retainer 5. In an example, other fasteners such as screws 23 can be employed to secure a position of a retainer ring 16. Another version can use fasteners (e.g., screws 24) to open and close filling ports for purging fluid and/or air from clutch 0.

In some embodiments, the sleeve 20 can further include a cam sleeve 2. The cam sleeve 2 can be axially restrained by the retainer ring 16 and restrained to the mandrel 1 to not rotate with a fixture or an assembly. For example, the assembly can comprise a roller 83 (FIGS. 3A-3C), roller pusher 84, cover plate 85 and roller spring 86.

Figure 5:
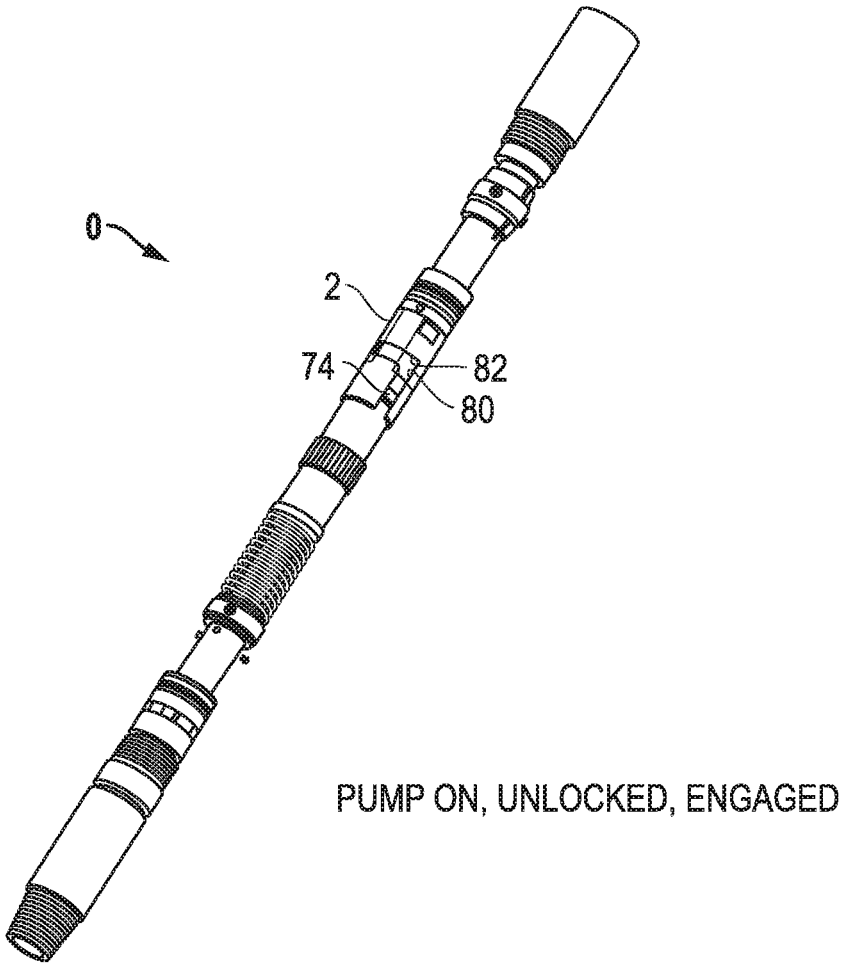
FIG. 5 is an isometric view of an embodiment of a clutch with some components removed and the cam sleeve transparent, and is shown in a pump on, unlocked engaged position.
Figure 6:
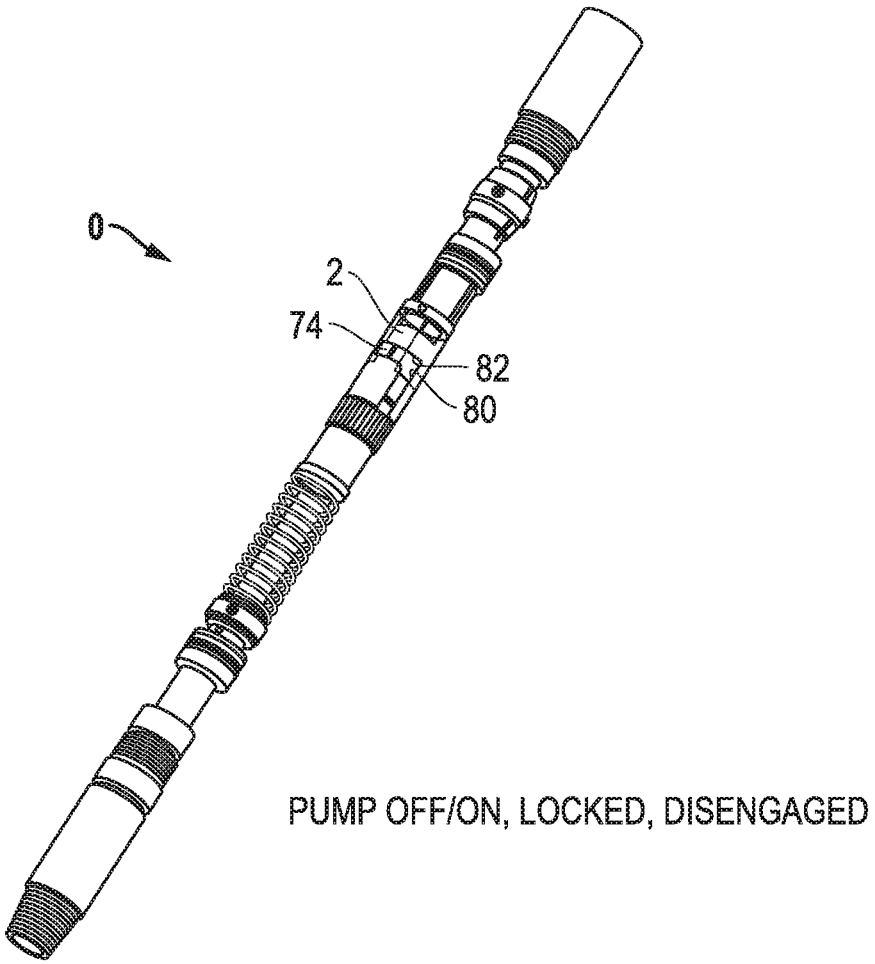
FIG. 6 is an isometric view of an embodiment of a clutch with some components removed and the cam sleeve transparent, and is shown in a pump off/on, locked disengaged position.

FIG. 5 is an isometric view of an embodiment of a clutch with some components removed and the cam sleeve transparent, and is shown in a pump on, unlocked engaged position. FIG. 6 is an isometric view of an embodiment of a clutch with some components removed and the cam sleeve transparent, and is shown in a pump off/on, locked disengaged position.

Embodiments of the sleeve 20 can be provided with a protrusion 74 (e.g., two shown). As shown in FIGS. 1, 3, 5 and 6, versions of the cam sleeve 2 can include a slot 80 and recess 82, and the protrusion 74 is configured to move in the slot 80 and recess 82 between the engaged and disengaged positions. In other versions the components can be reversed, such that the protrusion is located on the cam sleeve 2, and the slot and recess are in the sleeve 20.

Embodiments of the clutch 0 (FIG. 1) can further comprise other components, such as one or more of a sleeve piston assembly 17*a*, a radial bearing 4, a cam sleeve retainer ring 16 and an o-ring 21 (e.g., four shown). Such additional components can be coupled to the top sub 9 and the sleeve 20. Examples of the radial bearing 4 can be secured to the tubular member 3 with screws 12. The tubular member 3 can be threadingly coupled to the top sub 9. The sleeve piston assembly 17*a* can be configured to move axially, such as downward or downhole when fluid is flowing through the clutch 0 via fluid pressure, and upward or uphole by spring force when no fluid is flowing through the clutch 0.

When no fluid is flowing through the clutch 0, the cam sleeve 2 is pushed upwards (FIGS. 4A and 4C) by the spring 6 and spring bushing 10. In an example, extensions on the cam sleeve 2 can be used to push the upper piston assembly 17*a* upwards until the sleeve 20 disengages the mandrel spline 42 on mandrel 1. The protrusions 74 on the sleeve 20 can align and move in the slots 80 (compare FIGS. 5 and 6) on the cam sleeve 2. The sleeve 20 can stay engaged with the inner spline (not shown) in the tubular member 3. Rotating the well string 97 clockwise, rotates the tubular member 3 and sleeve 20, such that the protrusions 74 on sleeve 20 slide into recesses 82 (FIG. 6). The extensions on the cam sleeve 2 engage the roller pusher 84 (FIG. 3) and release the cam sleeve 2 to freely rotate in the clockwise direction. The sleeve 20 can stay locked in the disengaged position until counter-clockwise rotation is applied to the well string 97.

Figure 7:
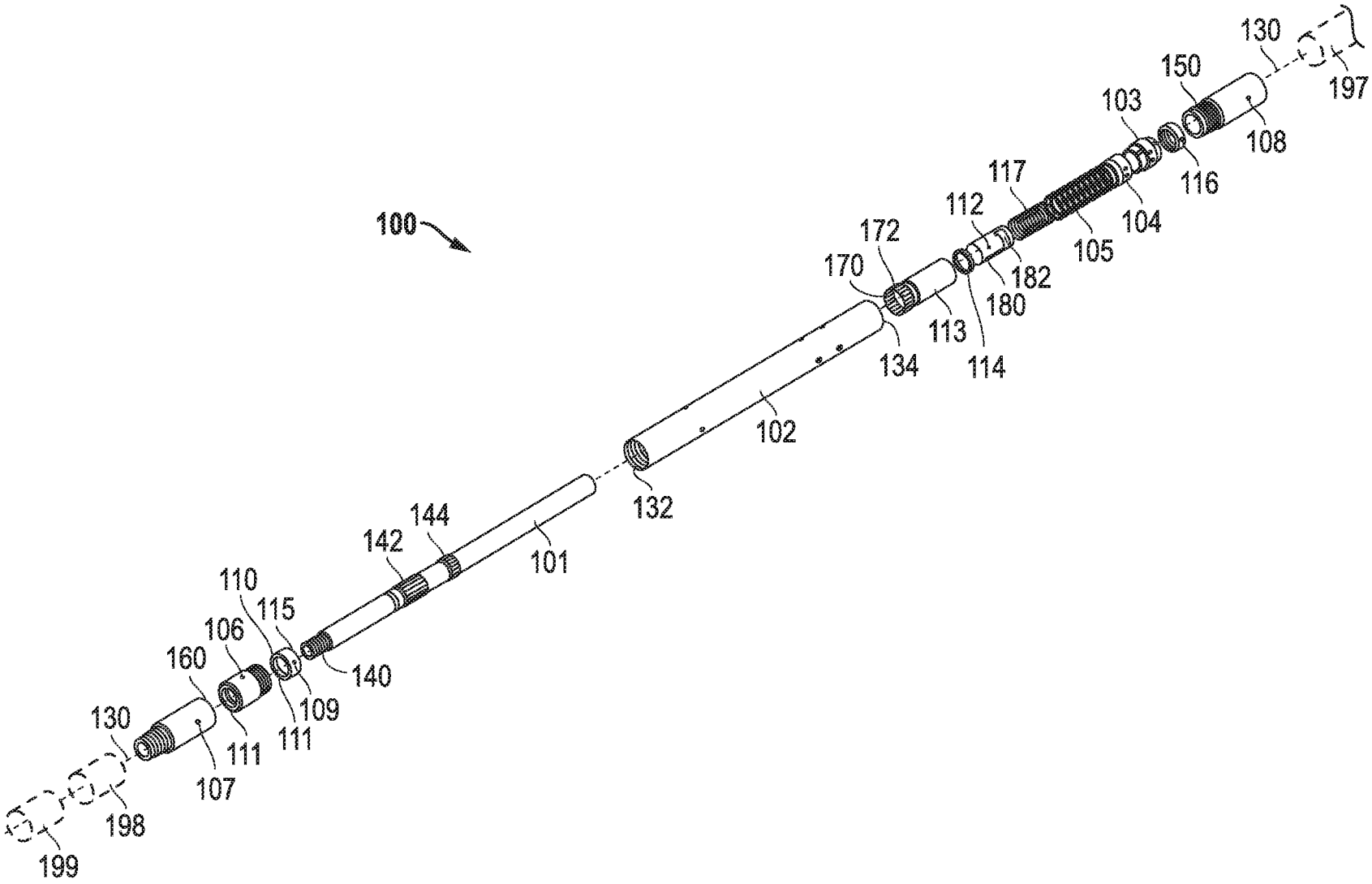
FIG. 7 is an exploded isometric view of another embodiment of a clutch for a well string and other well string components, shown unassembled.
Figure 8:
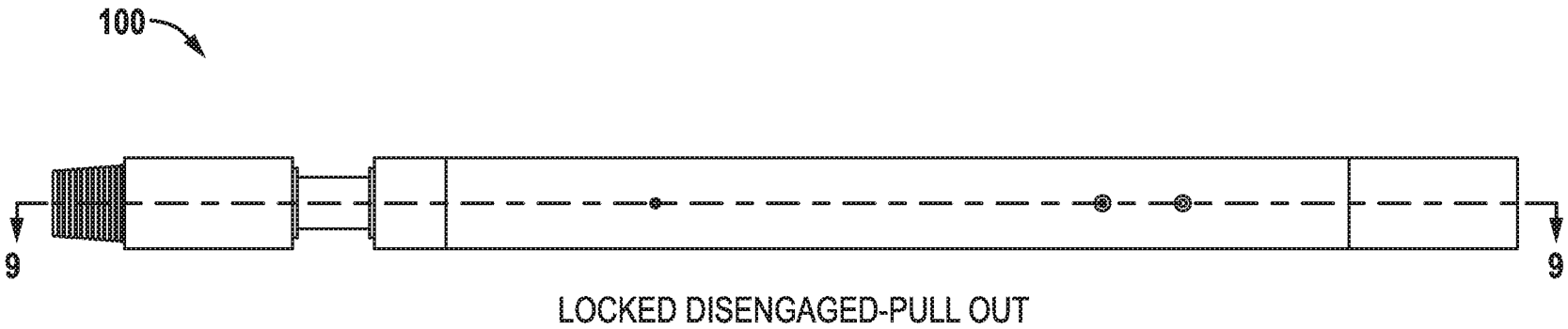
FIG. 8 is a side view of the clutch of FIG. 7, shown in a locked disengaged-pull out position.
Figure 9:
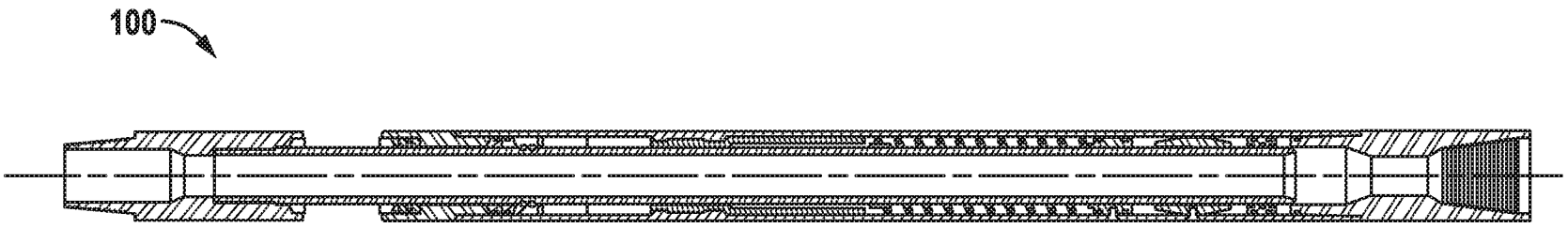
FIG. 9 is a sectional side view of the clutch of FIG. 8, taken along the line 9-9 of FIG. 8.
Figure 10A:
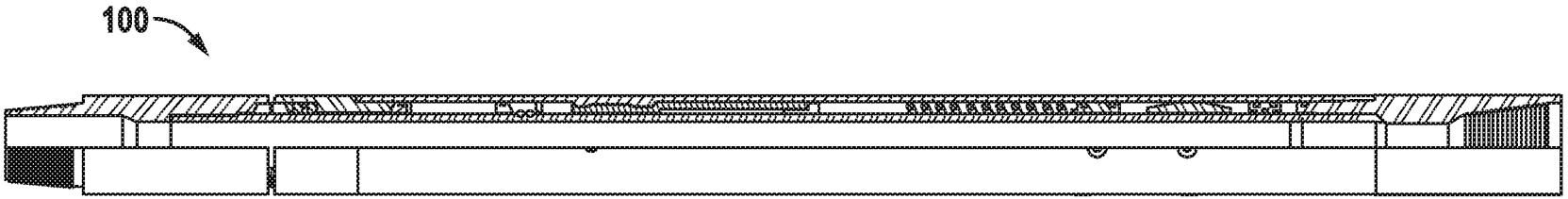
FIGS. 10A-10C are half-sectioned side views of the clutch of FIG. 7, showing locked disengaged-WOB, unlocked engaged-WOB, and unlocked disengaged-pull out positions, respectively.
Figure 10B:
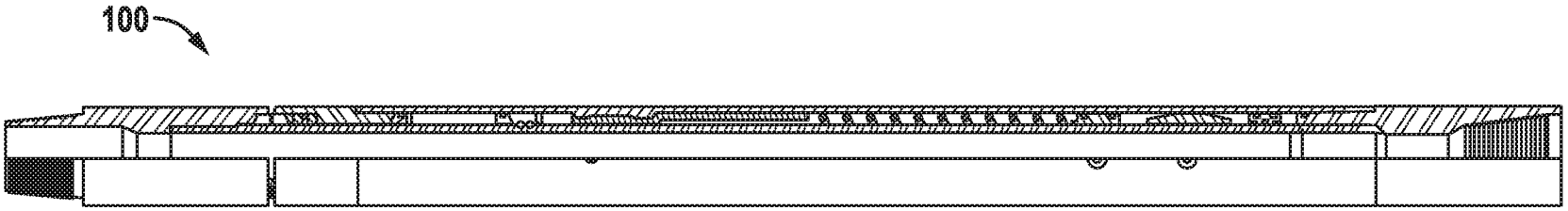
Figure 10C:
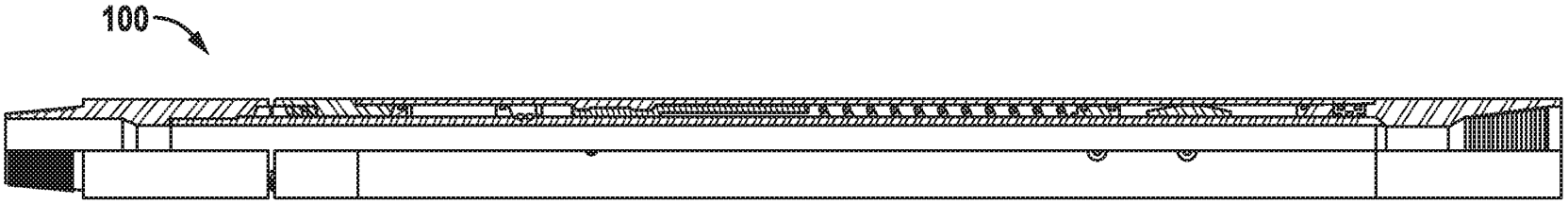

FIGS. 7-10C depict another embodiment of a clutch 100 for a downhole component 199 in a well. For example, FIG. 8 is a side view of the clutch of FIG. 7, shown in a locked disengaged-pull out position. FIG. 9 is a sectional side view of the clutch of FIG. 8, taken along the line 9-9 of FIG. 8. FIGS. 10A-10C are half-sectioned side views of the clutch of FIG. 7, showing locked disengaged-WOB, unlocked engaged-WOB, and unlocked disengaged-pull out positions, respectively.

Embodiments of the clutch 100 are configured to be directly coupled or indirectly coupled to the downhole component 199 via at least one other component 198. Clutch 100 is similar to clutch 0, as are the uphole and downhole components previously described. In this version, however, only mechanical rather than hydraulic means are used to actuate the clutch 100. For example, the clutch 100 can include a tubular member 102 having an axis 130, a tubular spline (not shown, on interior) and a tubular thread 132, 134 on each end.

The clutch 100 can include a mandrel 101 located in the tubular member 102. Versions of the mandrel 101 can comprise a mandrel thread 140 on a distal end and a mandrel spline 142 proximal to the mandrel thread 140. Embodiments of the mandrel 101 can comprise grooves 146 adjacent its distal end. The grooves 146 can provide an anchor point for an axial bearing support 109 and a retainer ring 110. A top sub 108 can be coupled to the tubular member 102. The top sub 108 can have a top sub thread 150 coupled to the tubular thread 134. In addition, a bottom sub 107 can be coupled to the mandrel 101. The bottom sub 107 can comprise a bottom sub thread 160 coupled to the mandrel thread 140.

Embodiments of the clutch 100 can comprise a sleeve 113 located between the tubular member 102 and the mandrel 101. For examples, the sleeve 113 can have an engaged position (FIG. 10B) wherein an inner sleeve spline 170 is coupled to the mandrel spline 142. Sleeve 112 also can have a disengaged position (FIGS. 8-10A and 10C) wherein the inner sleeve spline 170 is uncoupled from the mandrel spline 142. In addition, the sleeve 113 also can have an outer sleeve spline 172 that is coupled to the tubular spline (not shown) in the engaged position. The outer sleeve spline 172 can be uncoupled from the tubular spline in the disengaged position.

Clutch 100 can comprise a spring 105 located in the tubular member 102. In an example, the spring 105 can bias the sleeve 113 from the disengaged position to the engaged position. In some embodiments of the clutch 100, the spring 105 can be located uphole relative to the sleeve 113. In some examples, the spring 105 can comprise the outer spring 105, and can further comprise an inner spring 117 and a spring retainer 104 coupled to the outer spring 105. Features such as holes in the tubular member 102 can used to position the spring retainer 104 and the radial bearing 103. Other apertures can be accessed for oil filling and purging air.

The sleeve 113 can be configured to be biased from the engaged position to the disengaged position and overcome the spring bias when weight on bit (WOB) is decreased on a well string 197 coupled to the clutch 100. The spring 105 can be configured to move the sleeve 113 when WOB is increased on the well string 197.

Embodiments of the clutch 100 can operate at one or more WOB decreases. WOB can be decreased at least somewhat on the downhole component 199. In another example, at least about 99% WOB remains on the downhole component 199 to overcome the spring bias. In other versions, at least about 95% WOB, such as at least about 90% WOB, at least about 80% WOB, at least about 70% WOB, at least about 60% WOB, at least about 50% WOB, at least about 40% WOB, at least about 30% WOB, at least about 20% WOB, at least about 10% WOB, at least about 5% WOB, or even at least about 1% WOB remains on the downhole component 199 to overcome the spring bias. In other embodiments, the WOB reduction can be in a range between any of these values.

Versions of the clutch 100 can further include at least one of an end cap 106, an axial bearing 111 (e.g., two shown), an axial bearing support 109, a retainer ring 110 and a retainer plate 115, coupled to the bottom sub 107. In some embodiments, end cap axial bearings 111 can be located in bottom sub 107 and in bearing axial support 109, allowing the tubular member 102 to move axially a selected distance (FIGS. 7 and 8), such as several inches, relative to the mandrel 101, to perform lock and unlock sequences. The bottom sub 107 can be threadingly coupled to the mandrel 101. The bearing axial support 109 can be secured to the mandrel 101 with the retainer ring 110 and the retainer plate 115.

In some embodiments of the clutch 100, the sleeve 113 can further comprise a cam sleeve 112 and a sliding ring 114. The outer spring 105 can engage the sleeve 113 when WOB is applied. The inner spring 117 can maintain a position of the cam sleeve 112 against the sliding ring 114, and provide axial forgiveness and sufficient friction to allow for relative movement between sleeve 113 and the cam sleeve 112 in the locking and unlocking process.

Other embodiments of the mandrel 101 can further comprise a second spline 144 for supporting the sliding ring 114. The splines 142, 144 on the mandrel 101 can be the same of different. For example, spline 142 can be longer than spline 144 and engage sleeve 113. Spline 144 can provide axial support for the sliding ring 114. The spline 144 can be configured to allow the spline 170 of sleeve 113 to pass over it during the assembly process.

Examples of the clutch 100 can include the sleeve 113 with a protrusion (on interior, not shown), and the cam sleeve 112 with a slot 180 and a recess 182. The protrusion (not shown) can be configured to move in the slot 180 and the recess 182 between the engaged and disengaged positions. The opposite configuration also is possible, as described elsewhere herein. One version of the clutch 100 can further comprise a radial bearing 103 and a seal assembly 116. These components can be coupled to the top sub 108.

Embodiments of a method of engaging and disengaging a downhole component in a well also are disclosed. For example, a hydraulic version of the method can include: providing a well string with the downhole component and a clutch coupled to the downhole component; operating the downhole component and pumping fluid through the clutch to the downhole component; stop pumping fluid through the clutch to the downhole component, such that the clutch disengages the downhole component and the downhole component no longer operates when the well string is rotated; and then pumping fluid through the clutch to the downhole component, such that the clutch re-engages the downhole component and re-commencing operation with the downhole component.

In some versions, the stop pumping step can further comprise rotating the well string in a first direction to lock the clutch in a disengaged position while no fluid is pumped. In a particular example, this step can include rotating the well string clockwise about 360 degrees to about 720 degrees to lock the clutch in the disengaged position.

Embodiments of the stop pumping step can further include rotating the well string in a second direction to unlock the clutch from the disengaged position while no fluid is pumped. In a particular example, this step can include rotating the well string counterclockwise about 360 degrees to about 720 degrees to unlock the clutch from the disengaged position. In addition, the stop pumping step can include hole cleaning and friction-breaking with the uphole portion of the well string.

Other embodiments of the method of engaging and disengaging a downhole component can include only mechanical steps. For example, the method can include providing a well string with the downhole component and a clutch coupled to the downhole component; operating the downhole component with weight on bit (WOB); reducing WOB such that the clutch disengages the downhole component and the downhole component no longer rotates when the well string is rotated; and then increasing WOB to re-engage the clutch with the downhole component and re-commencing operation with the downhole component.

Embodiments of the reducing WOB step can occur while no fluid is pumped. The reducing WOB step can further comprise rotating the well string in a first direction to lock the clutch in a disengaged position. For example, this step can include rotating the well string clockwise about 360 degrees to about 720 degrees to lock the clutch in the disengaged position.

Other embodiments of the reducing WOB step can include rotating the well string in a second direction to unlock the clutch from the disengaged position. In a particular example, this step can include rotating the well string is counterclockwise about 360 degrees to about 720 degrees to unlock the clutch from the disengaged position.

In still other embodiments, a system for engaging and disengaging a downhole component in a well are disclosed. For example, the system can include a hydraulic version. Versions of the system can include a well string comprising the downhole component and a clutch coupled to the downhole component. The clutch can include at least some of the following components: a tubular member having an axis, a tubular spline, and a tubular thread on each end; a mandrel located in the tubular member, the mandrel having a mandrel thread on a distal end and a mandrel spline proximal to the mandrel thread; a top sub coupled to the tubular member, the top sub having a top sub thread coupled to the tubular thread; a bottom sub coupled to the mandrel, the bottom sub having a bottom sub thread coupled to the mandrel thread; a sleeve located between the tubular member and the mandrel, the sleeve having an engaged position wherein an inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline also is coupled to the tubular spline in the disengaged position; a spring located in the tubular member for biasing the sleeve from the engaged position to the disengaged position; and the sleeve is configured to be hydraulically biased from the disengaged position to the engaged position to overcome the spring bias when fluid flows through the clutch.

Embodiments of a mechanical system for engaging and disengaging a downhole component in a well also are disclosed. For example, a well string can comprise the downhole component and a clutch coupled to the downhole component. The clutch can include at least some of the following components: a tubular member having an axis and a tubular thread; a mandrel located in the tubular member, the mandrel having a mandrel thread on a distal end and a mandrel spline proximal to the mandrel thread; a top sub coupled to the tubular member, the top sub having a top sub thread coupled to the tubular thread; a bottom sub coupled to the mandrel, the bottom sub having a bottom sub thread coupled to the mandrel thread; a sleeve located between the tubular member and the mandrel, the sleeve having an engaged position wherein an inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline is uncoupled from the tubular spline in the disengaged position; a spring located in the tubular member for biasing the sleeve from the disengaged position to the engaged position; and the sleeve is configured to be biased from the engaged position to the disengaged position and overcome the spring bias when weight on bit (WOB) is decreased on the well string.

Still other versions can include one or more of the following embodiments:

Embodiment 1. A clutch for a downhole component in a well, the clutch comprising:

a tubular member having an axis, a tubular spline, and a tubular thread on each end;

a mandrel located in the tubular member, the mandrel having a mandrel thread on a distal end and a mandrel spline proximal to the mandrel thread;

a top sub coupled to the tubular member, the top sub having a top sub thread coupled to the tubular thread;

a bottom sub coupled to the mandrel, the bottom sub having a bottom sub thread coupled to the mandrel thread;

a sleeve located between the tubular member and the mandrel, the sleeve having an engaged position wherein an inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline also is coupled to the tubular spline in the disengaged position;

a spring located in the tubular member for biasing the sleeve from the engaged position to the disengaged position; and the sleeve is configured to be hydraulically biased from the disengaged position to the engaged position to overcome the spring bias when fluid flows through the clutch.

Embodiment 2. The clutch of any of these embodiments, wherein the downhole component is at least one of a bottom hole assembly (BHA), a production string and a fracturing string.

Embodiment 3. The clutch of any of these embodiments, wherein the clutch is configured to be located axially uphole from the downhole component, such that the clutch is configured to be directly coupled or indirectly coupled to the downhole component via at least one other component, and the clutch is configured to be coupled to an uphole portion of a well string.

Embodiment 4. The clutch of any of these embodiments, wherein the downhole component comprises a bottom hole assembly (BHA) having a drill bit, mud motor, collars and tools.

Embodiment 5. The clutch of any of these embodiments, wherein the spring is located downhole relative to the sleeve.

Embodiment 6. The clutch of any of these embodiments, wherein the sleeve further comprises a cam sleeve.

Embodiment 7. The clutch of any of these embodiments, wherein the sleeve comprises a protrusion, the cam sleeve comprises a slot and recess, and the protrusion is configured to move in the slot and recess between the engaged and disengaged positions.

Embodiment 8. The clutch of any of these embodiments, further comprising a sleeve piston assembly and a radial bearing, cam sleeve retainer ring and at least one o-ring coupled to the top sub and the sleeve.

Embodiment 9. The clutch of any of these embodiments, wherein the spring comprises a spring bushing coupled to the sleeve, and a spring retainer and at least one o-ring located opposite the spring bushing.

Embodiment 10. The clutch of any of these embodiments, further comprising an end cap, at least one axial bearing, retainer ring, retainer plate and spring piston assembly coupled to the bottom sub and the spring.

Embodiment 11. A clutch for a downhole component in a well, the clutch comprising:

a tubular member having an axis, a tubular spline and a tubular thread on each end;

a mandrel located in the tubular member, the mandrel having a mandrel thread on a distal end and a mandrel spline proximal to the mandrel thread;

a top sub coupled to the tubular member, the top sub having a top sub thread coupled to the tubular thread;

a bottom sub coupled to the mandrel, the bottom sub having a bottom sub thread coupled to the mandrel thread;

a sleeve located between the tubular member and the mandrel, the sleeve having an engaged position wherein an inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline is uncoupled from the tubular spline in the disengaged position;

a spring located in the tubular member for biasing the sleeve from the disengaged position to the engaged position; and the sleeve is configured to be biased from the engaged position to the disengaged position and overcome the spring bias when weight on bit (WOB) is decreased on a well string coupled to the clutch.

Embodiment 12. The clutch of any of these embodiments, wherein, when WOB is decreased at least somewhat on the downhole component, when at least about 99% WOB remains on the downhole component, or at least about 95% WOB, at least about 90% WOB, at least about 80% WOB, at least about 70% WOB, at least about 60% WOB, or at least about 50% WOB, at least about 40% WOB, at least about 30% WOB, at least about 20% WOB, at least about 10% WOB, at least about 5% WOB, or even at least about 1% WOB remains on the downhole component.

Embodiment 13. The clutch of any of these embodiments, wherein the spring is configured to move the sleeve when WOB is increased on the well string.

Embodiment 14. The clutch of any of these embodiments, further comprising an end cap, at least one axial bearing, axial bearing support, retainer ring and retainer plate coupled to the bottom sub.

Embodiment 15. The clutch of any of these embodiments, wherein the spring is located uphole relative to the sleeve.

Embodiment 16. The clutch of any of these embodiments, wherein the spring comprises an outer spring, and further comprises an inner spring and a spring retainer coupled to the outer spring.

Embodiment 17. The clutch of any of these embodiments, wherein the sleeve further comprises a cam sleeve and a sliding ring.

Embodiment 18. The clutch of any of these embodiments, wherein the mandrel further comprises a second spline for supporting a sliding ring.

Embodiment 19. The clutch of any of these embodiments, wherein the sleeve comprises a protrusion, the cam sleeve comprises a slot and a recess, and the protrusion is configured to move in the slot and the recess between the engaged and disengaged positions.

Embodiment 20. The clutch of any of these embodiments, further comprising a radial bearing and seal assembly coupled to the top sub.

Embodiment 21. A method of engaging and disengaging a downhole component in a well, the method comprising:

(a) providing a well string with the downhole component and a clutch coupled to the downhole component;

(b) operating the downhole component and pumping fluid through the clutch to the downhole component;

(c) stop pumping fluid through the clutch to the downhole component, such that the clutch disengages the downhole component and the downhole component no longer operates when the well string is rotated; and then (d) pumping fluid through the clutch to the downhole component, such that the clutch re-engages the downhole component and re-commencing operation with the downhole component.

Embodiment 22. The method of any of these embodiments, wherein step (c) further comprises rotating the well string in a first direction to lock the clutch in a disengaged position while no fluid is pumped.

Embodiment 23. The method of any of these embodiments, further comprising rotating the well string clockwise about 360 degrees to about 720 degrees to lock the clutch in the disengaged position.

Embodiment 24. The method of any of these embodiments, wherein step (c) further comprises rotating the well string in a second direction to unlock the clutch from the disengaged position while no fluid is pumped.

Embodiment 25. The method of any of these embodiments, further comprising rotating the well string counterclockwise about 360 degrees to about 720 degrees to unlock the clutch from the disengaged position.

Embodiment 26. The method of any of these embodiments, wherein step (c) further comprises hole cleaning and friction-breaking.

Embodiment 27. A method of engaging and disengaging a downhole component, the method comprising:

(a) providing a well string with the downhole component and a clutch coupled to the downhole component;

(b) operating the downhole component with weight on bit (WOB);

(c) reducing WOB such that the clutch disengages the downhole component and the downhole component no longer rotates when the well string is rotated; and then (d) increasing WOB to re-engage the clutch with the downhole component and re-commencing operation with the downhole component.

Embodiment 28. The method of any of these embodiments, wherein step (c) occurs while no fluid is pumped.

Embodiment 29. The method of any of these embodiments, wherein step (c) further comprises rotating the well string in a first direction to lock the clutch in a disengaged position.

Embodiment 30. The method of any of these embodiments, further comprising rotating the well string clockwise about 360 degrees to about 720 degrees to lock the clutch in the disengaged position.

Embodiment 31. The method of any of these embodiments, wherein step (c) further comprises rotating the well string in a second direction to unlock the clutch from the disengaged position.

Embodiment 32. The method of any of these embodiments, further comprising rotating the well string is counterclockwise about 360 degrees to about 720 degrees to unlock the clutch from the disengaged position.

Embodiment 33. A system for engaging and disengaging a downhole component in a well, the system comprising:

a well string comprising the downhole component and a clutch coupled to the downhole component; wherein the clutch comprises:

a tubular member having an axis, a tubular spline, and a tubular thread on each end;

a mandrel located in the tubular member, the mandrel having a mandrel thread on a distal end and a mandrel spline proximal to the mandrel thread;

a top sub coupled to the tubular member, the top sub having a top sub thread coupled to the tubular thread;

a bottom sub coupled to the mandrel, the bottom sub having a bottom sub thread coupled to the mandrel thread;

a sleeve located between the tubular member and the mandrel, the sleeve having an engaged position wherein an inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline also is coupled to the tubular spline in the disengaged position;

a spring located in the tubular member for biasing the sleeve from the engaged position to the disengaged position; and the sleeve is configured to be hydraulically biased from the disengaged position to the engaged position to overcome the spring bias when fluid flows through the clutch.

Embodiment 34. A system for engaging and disengaging a downhole component in a well, the system comprising:

a well string comprising the downhole component and a clutch coupled to the downhole component; wherein the clutch comprises:

a tubular member having an axis and a tubular thread;

a mandrel located in the tubular member, the mandrel having a mandrel thread on a distal end and a mandrel spline proximal to the mandrel thread;

a top sub coupled to the tubular member, the top sub having a top sub thread coupled to the tubular thread;

a bottom sub coupled to the mandrel, the bottom sub having a bottom sub thread coupled to the mandrel thread;

a sleeve located between the tubular member and the mandrel, the sleeve having an engaged position wherein an inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline is uncoupled from the tubular spline in the disengaged position;

a spring located in the tubular member for biasing the sleeve from the disengaged position to the engaged position; and the sleeve is configured to be biased from the engaged position to the disengaged position and overcome the spring bias when weight on bit (WOB) is decreased on the well string.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A clutch for a downhole component in a well, the clutch comprising:

a tubular member having an axis, a tubular spline and a tubular member connector on each end;

a mandrel located in the tubular member, the mandrel having a mandrel connector for coupling with a well string on one end and a mandrel spline on an outer surface thereof;

a sleeve located between the tubular member and the mandrel, the sleeve having an inner sleeve spline, an engaged position wherein the inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline is uncoupled from the tubular spline in the disengaged position;

a spring located in the tubular member for biasing the sleeve from the disengaged position to the engaged position; and the sleeve is configured to be biased from the engaged position to the disengaged position when axial compressive force acting on the clutch is lower than a set amount.

2. The clutch of claim 1, wherein the set amount of axial compressive force to move the sleeve to the engaged position is at least about 90% of drilling weight on bit (WOB).

3. The clutch of claim 1, wherein the sleeve is configured to be biased from the engaged position to the disengaged position and overcome the spring bias when weight on bit (WOB) is decreased on the well string coupled to the clutch.

4. The clutch of claim 3, wherein at least about 90% WOB remains on the well string to overcome the spring bias.

5. The clutch of claim 3, wherein the spring is configured to move the sleeve when WOB is increased on the well string.

6. The clutch of claim 1, further comprising at least one bearing located between the tubular member and the mandrel.

7. The clutch of claim 1, further comprising:

a top sub coupled to the tubular member, the top sub having a top sub thread coupled to the tubular member connector; and a bottom sub coupled to the mandrel, the bottom sub having a bottom sub connector coupled to the mandrel connector.

8. The clutch of claim 7, further comprising an end cap, at least one axial bearing, axial bearing support, retainer ring and retainer plate coupled to the bottom sub.

9. The clutch of claim 7, further comprising a radial bearing and seal assembly coupled to the top sub.

10. The clutch of claim 1, wherein the spring comprises an outer spring, and an inner spring and a spring retainer coupled to the outer spring.

11. The clutch of claim 1, wherein the sleeve further comprises a cam sleeve and a sliding ring.

12. The clutch of claim 11, wherein the mandrel further comprises a second spline for supporting the sliding ring.

13. The clutch of claim 11, wherein the sleeve comprises a protrusion, the cam sleeve comprises a slot and a recess, and the protrusion is configured to move in the slot and the recess between the engaged and disengaged positions.

14. A method of engaging and disengaging a downhole component, the method comprising:

(a) providing a well string with the downhole component and a clutch coupled to the downhole component;

(b) operating the downhole component with weight on bit (WOB);

(c) reducing WOB such that the clutch disengages the downhole component and the downhole component no longer rotates when the well string is rotated; and then (d) increasing WOB to re-engage the clutch with the downhole component and re-commencing operation with the downhole component, wherein step (c) occurs while no fluid is pumped.

15. A method of engaging and disengaging a downhole component, the method comprising:

(a) providing a well string with the downhole component and a clutch coupled to the downhole component;

(b) operating the downhole component with weight on bit (WOB);

(c) reducing WOB such that the clutch disengages the downhole component and the downhole component no longer rotates when the well string is rotated; and then (d) increasing WOB to re-engage the clutch with the downhole component and re-commencing operation with the downhole component, wherein step (c) further comprises rotating the well string in at least one of a first direction to lock the clutch in a disengaged position and in a second direction to unlock the clutch from the disengaged position.

16. The method of claim 15, further comprising rotating the well string in the first direction about 360 degrees to about 720 degrees to lock the clutch in the disengaged position.

17. The method of claim 15, wherein step (c) further comprises rotating the well string in the first direction to lock the clutch in the disengaged position and in the second direction to unlock the clutch from the disengaged position.

18. The method of claim 15, further comprising rotating the well string in the second direction about 360 degrees to about 720 degrees to unlock the clutch from the disengaged position.

19. A system for engaging and disengaging a downhole component in a well, the system comprising:

a well string comprising the downhole component and a clutch coupled to the downhole component; wherein the clutch comprises:

a tubular member having an axis, a tubular spline and a tubular member connector on each end;

a mandrel located in the tubular member, the mandrel having a mandrel connector for coupling with the well string on one end and a mandrel spline on an outer surface thereof;

a sleeve located between the tubular member and the mandrel, the sleeve having an inner sleeve spline, an engaged position wherein the inner sleeve spline is coupled to the mandrel spline, and a disengaged position wherein the inner sleeve spline is uncoupled from the mandrel spline, the sleeve also having an outer sleeve spline that is coupled to the tubular spline in the engaged position, and the outer sleeve spline is uncoupled from the tubular spline in the disengaged position;

a spring located in the tubular member for biasing the sleeve from the disengaged position to the engaged position; and the sleeve is configured to be biased from the engaged position to the disengaged position when axial compressive force acting on the clutch is lower than a set amount.

* * * * *